US008386090B1

(12) United States Patent
Hobbs, Jr. et al.

(10) Patent No.: US 8,386,090 B1
(45) Date of Patent: Feb. 26, 2013

(54) SYSTEM AND METHOD FOR WIRELESS REMOTE OPERATION OF AN ACCESSORY ASSOCIATED WITH A VEHICLE

(75) Inventors: Kenneth Patrick Hobbs, Jr., Louisville, KY (US); Steven H. Taylor, Crestwood, KY (US)

(73) Assignee: Brinly-Hardy Company, Jeffersonville, IN (US)

( * ) Notice: Subject to any disclaimer, the term of this patent is extended or adjusted under 35 U.S.C. 154(b) by 490 days.

(21) Appl. No.: 12/705,732

(22) Filed: Feb. 15, 2010

Related U.S. Application Data

(60) Provisional application No. 61/152,426, filed on Feb. 13, 2009.

(51) Int. Cl.
*G05D 1/00* (2006.01)

(52) U.S. Cl. ..... 701/2; 340/426.13

(58) Field of Classification Search ..... 701/2, 24; 340/426.28, 5.64, 426.17, 425.5, 426.36, 340/426.13; 307/10.1, 10.3; 341/176, 173
See application file for complete search history.

(56) References Cited

U.S. PATENT DOCUMENTS

| | | | | |
|---|---|---|---|---|
| 1,901,297 | A | 3/1933 | Hurt | |
| 3,651,623 | A | 3/1972 | Harley | |
| 4,350,287 | A | 9/1982 | Richards | |
| 4,776,750 | A | 10/1988 | Griswold, Jr. et al. | |
| 5,524,368 | A | 6/1996 | Struck et al. | |
| 5,975,162 | A | 11/1999 | Link, Jr. | |
| 6,078,252 | A | 6/2000 | Kulczycki et al. | |
| 6,148,212 | A | 11/2000 | Park et al. | |
| 6,752,328 | B2 | 6/2004 | Sauls | |
| RE38,665 | E | 12/2004 | Struck et al. | |
| 6,852,934 | B1 | 2/2005 | Lashua | |
| 6,938,829 | B2 | 9/2005 | Doherty et al. | |
| 7,106,171 | B1 | 9/2006 | Burgess | |
| 7,328,757 | B2 | 2/2008 | Davies | |
| 7,349,772 | B2 | 3/2008 | Delaney et al. | |
| 2005/0030197 | A1 * | 2/2005 | Greenacre et al. | 340/825.72 |
| 2008/0266888 | A1 * | 10/2008 | Wayne et al. | 362/487 |

FOREIGN PATENT DOCUMENTS

| | | |
|---|---|---|
| EP | 0070833 | 4/1982 |
| EP | 139673 | 9/1984 |

(Continued)

OTHER PUBLICATIONS

Logis Computer Inc., Model #RM01, 12V 6A Relay w/Remote Control product information, downloaded Jan. 15, 2009 at http://www.logisyscomputer.com/viewsku.asp?SKUID=RM01&DID=REMOTE.

(Continued)

*Primary Examiner* — Thomas Black
*Assistant Examiner* — Luke Huynh
(74) *Attorney, Agent, or Firm* — Stites & Harbison, PLLC; David W. Nagle, Jr.; Jeffrey A. Haeberlin

(57) ABSTRACT

A system and method for wireless remote operation of an accessory associated with a vehicle includes: providing a wireless remote control transmitter device for transmitting a plurality of signals, and a wireless remote control receiver device including a signal receiver for receiving the plurality of signals from the wireless remote control transmitter device, an input in electrical communication with a vehicle key switch device, and an output in electrical communication with the accessory; providing, by the vehicle key switch device, power to the wireless remote control receiver device in response to receiving a vehicle operation code from a vehicle key and movement of the vehicle key switch device from an OFF position to an ON position; and controlling, by the wireless remote control receiver device, the accessory based on the plurality of signals received from the wireless remote control transmitter device.

19 Claims, 4 Drawing Sheets

FOREIGN PATENT DOCUMENTS

| | | | |
|---|---|---|---|
| EP | 956522 | B1 | 5/2002 |
| EP | 1487656 | A1 | 12/2004 |
| GB | 2019705 | | 11/1979 |
| JP | 6227308 | | 8/1994 |
| WO | 2007050406 | A1 | 5/2007 |
| WO | 2008097283 | A1 | 8/2008 |

OTHER PUBLICATIONS

The Toro Company, Pro Force™ Debris Blower product information available at http://www.toro.com/grounds/docs/Pro%20Force%20Sell%20Sheet%20090126.pdf.

DR Power Equipment, DR® Power Grader Safety * Operating Instructions available at http://www.drpower.com/CHPContent/content/support/manuals/230981A_PRG_withRemote_SO_70618.pdf?cm_sp=OwnersManuals-_-PGR-_-manual-48in_remote-230981A, and DR Power Graders overview and features downloaded on Jan. 15, 2009 at http://www.drpower.com/power-grader.aspx.

The Sportsman'S Club, online catalog, product information for Great Day Power Punch Remote Control, available at http://www.sportsmansguide.com/net/cb/cb.aspx?a=292090.

* cited by examiner

SYSTEM AND METHOD FOR WIRELESS REMOTE OPERATION OF AN ACCESSORY ASSOCIATED WITH A VEHICLE

CROSS-REFERENCE TO RELATED APPLICATIONS

The present application claims priority to U.S. Provisional Patent Application Ser. No. 61/152,426 filed on Feb. 13, 2009, the entire disclosure of which is incorporated herein by reference.

BACKGROUND OF THE INVENTION

The present invention relates to a system and method for wireless remote operation of an accessory associated with a vehicle.

Motor-operated accessories and equipment associated with vehicles (for example, but not limited to, lawn and garden attachments such as broadcast spreaders, sprayers, dethatchers, aerators, carts and sweepers mounted or otherwise connected to vehicle), often include controls for performing certain functions (e.g., turning on/off a motor or pump, raising/lowering an aerator, blade, or dethatcher, changing an angle of a blade, or dumping/raising a dump cart bed) that are inconvenient to operate because the electronic controls are mounted on the accessory and remote from the vehicle operator's position, or the operating compartment of the vehicle. Thus, the vehicle operator must leave the vehicle operator's position to operate the accessory. Alternatively, the controls can be relocated to the vehicle operator's position. However, the time and effort required to relocate the controls to the vehicle operator's position is often cumbersome. Further, for accessories that are not permanently mounted to the vehicle, relocation of the controls to the vehicle operator's position is undesired because, for the time that the accessories are not mounted to the vehicle, the controls create non-functional clutter at the vehicle operator's position. Still further, wires to the controls that have been relocated to the vehicle operator's position require bundling and tying to make up for differing lengths and varying configurations of vehicles, which is difficult and undesirable from the perspective of both the manufacturer and the installer.

Additionally, motorized or electrically powered accessories (e.g., spreaders, sprayers, electrically angled blades, electrically heated seat covers, etc.) that are directly connected to a vehicle power supply may inadvertently remain energized even when the vehicle is not running, as the power supply likely contains a battery that continues to supply power. This is undesirable for many reasons, but especially due to issues of power drain.

SUMMARY OF THE INVENTION

The present invention is a system and method for wireless remote operation of an accessory associated with a vehicle, and, more particularly, for the wireless remote operation of a motor of the accessory.

According to one aspect of the invention, a system for wireless remote operation of an accessory associated with a vehicle, comprises: a vehicle power supply device; a vehicle key; a vehicle key switch device; a wireless remote control transmitter device; and a wireless remote control receiver device. The vehicle power supply device is for supplying electrical power to the vehicle. The vehicle key is encoded with a vehicle operation code for operating the vehicle. The vehicle key switch device includes a vehicle power supply input in electrical communication with the vehicle power supply device, a vehicle key receiver for receiving the vehicle operation code from the vehicle key, and a vehicle key switch output. The vehicle key switch device switches connection of the vehicle key switch output to the vehicle power supply input in response to receiving the vehicle operation code from the vehicle key and moving the vehicle key switch device between an OFF position and an ON position. The wireless remote control transmitter device is for transmitting a plurality of control signals. Lastly, the wireless remote control receiver device includes a signal receiver for receiving the plurality of signals from the wireless remote control transmitter device, an input in electrical communication with the vehicle key switch output, and an output in electrical communication with the accessory. The wireless remote control receiver device controls the accessory based on the plurality of signals received from the wireless remote control transmitter when the vehicle key switch is in the ON position. Additionally, neither the wireless remote control receiver device nor the accessory is operable when the vehicle key switch device is in the OFF position.

In accordance with one implementation, the vehicle power supply device supplies electrical power to the accessory, and the wireless remote control receiver device controls the electrical power to the accessory. The system may further comprise an electrical switching device including a control input in electrical communication with the output of the wireless remote control receiver device, a power input in electrical communication with the vehicle power supply device, a power output in electrical communication with the accessory, and a switching mechanism for connecting the power output to the power input when a control signal is present at the control input.

In accordance with another implementation, the wireless remote control transmitter device has an ON button for transmitting an ON signal, and an OFF button for transmitting an OFF signal. A motor of the accessory is then started by the wireless remote control receiver device in response to activation of the ON button of the wireless remote control transmitter device and stopped by the wireless remote control receiver device in response to activation of the OFF button of the wireless remote control transmitter device. The accessory may be, for example, a broadcast spreader. Alternatively, the accessory may be a sprayer, and the motor may drive a pump of the sprayer.

In accordance with another implementation, the wireless remote control transmitter device has a RAISE button for transmitting a RAISE signal, and a LOWER button for transmitting a LOWER signal. The wireless remote control receiver device then causes the accessory to be raised in response to activation of the RAISE button of the wireless remote control transmitter device and lowered in response to activation of the LOWER button of the wireless remote control transmitter device. In this implementation, the accessory may be, for example, an aerator, a blade, a mower deck, a tiller, a scoop, a dump bucket, a pallet mover or a dethatcher.

In accordance with yet another implementation, the accessory is a blade. In this implementation, the wireless remote control receiver device controls the angle of the blade.

In accordance with yet another implementation, the accessory is a dump cart. In this implementation, the wireless remote control receiver device controls dumping of the dump cart.

In accordance with still yet another implementation, the wireless remote control receiver device controls a direction of turning of a motor of the accessory in response to receiving a corresponding signal from the wireless remote control transmitter device.

Another aspect of the invention is a method for wireless remote operation of an accessory associated with a vehicle. A vehicle key is encoded with a vehicle operation code for operating the vehicle. The vehicle includes a vehicle power supply device for supplying electrical power to the vehicle. The vehicle also includes a vehicle key switch device including a vehicle power supply input in electrical communication with the vehicle power supply device, a vehicle key receiver for receiving the vehicle operation code from the vehicle key, and a vehicle key switch output. The vehicle key switch device switches connection of the vehicle key switch output to the vehicle power supply input in response to receiving the vehicle operation code from the vehicle key and moving the vehicle key switch device between an OFF position and an ON position. The method comprises: providing a wireless remote control transmitter device for transmitting a plurality of signals, and a wireless remote control receiver device including a signal receiver for receiving the plurality of signals from the wireless remote control transmitter device, an input in electrical communication with the vehicle key switch output, and an output in electrical communication with the accessory; providing, by the vehicle key switch device, power to the wireless remote control receiver device in response to receiving the vehicle operation code from the vehicle key and movement of the vehicle key switch device from the OFF position to the ON position; and controlling, by the wireless remote control receiver device, the accessory based on the plurality of signals received from the wireless remote control transmitter. The method may further comprise disconnecting, by the vehicle key switch device, power to the wireless remote control receiver device in response to movement of the vehicle key switch device from the ON position to the OFF position.

In accordance with one implementation, the vehicle power supply device supplies electrical power to the accessory, and the wireless remote control receiver device controls the electrical power to the accessory.

In accordance with another implementation, the wireless remote control transmitter device has an ON button for transmitting an ON signal, and an OFF button for transmitting an OFF signal. The method then further comprises starting, by the wireless remote control receiver device, a motor of the accessory in response to activation of the ON button of the wireless remote control transmitter device, and stopping, by the wireless remote control receiver device, the motor of the accessory in response to activation of the OFF button of the wireless remote control transmitter device.

In accordance with yet another implementation, the wireless remote control transmitter device has a RAISE button for transmitting a RAISE signal, and a LOWER button for transmitting a LOWER signal. The method then further comprises raising, by the wireless remote control receiver device, the accessory in response to activation of the RAISE button of the wireless remote control transmitter device, and lowering, by the wireless remote control receiver device, the accessory in response to activation of the LOWER button of the wireless remote control transmitter device.

In accordance with still yet another implementation, the wireless remote control transmitter device has a first rotational direction button for transmitting a first rotational direction signal, and a second rotational direction signal button for transmitting a second rotational direction signal. The method then further comprises causing, by the wireless remote control receiver device, the accessory to have a first rotational direction in response to activation of the first rotational direction button of the wireless remote control transmitter device, and causing, by the wireless remote control receiver device, the accessory to have a second rotational direction in response to activation of the second rotational direction button of the wireless remote control transmitter device.

Yet another aspect of the invention is a system for wireless remote operation of an accessory associated with a vehicle, including: a vehicle power supply device; a vehicle key; a vehicle key switch device; an electrical switching device; a wireless remote control transmitter device; and a wireless remote control receiver device. The vehicle power supply device is for supplying electrical power to the vehicle. The vehicle key is encoded with a vehicle operation code for operating the vehicle. The vehicle key switch device includes a vehicle power supply input in electrical communication with the vehicle power supply device, a vehicle key receiver for receiving the vehicle operation code from the vehicle key, and a vehicle key switch output. The vehicle key switch device switches connection of the vehicle key switch output to the vehicle power supply input in response to receiving the vehicle operation code from the vehicle key and moving the vehicle key switch device between an OFF position and an ON position. The electrical switching device includes a control input in electrical communication with the vehicle key switch output, a power input, a power output, and a switching mechanism for connecting the power output to the power input when a control signal is present at the control input. The wireless remote control transmitter device is for transmitting a plurality of signals. The wireless remote control receiver device includes a signal receiver for receiving the plurality of signals from the wireless remote control transmitter device, an input in electrical communication with the power output of the electrical switching device, and an output in electrical communication with the accessory. Accordingly, the wireless remote control receiver device controls the accessory based on the plurality of signals received from the wireless remote control transmitter device when the vehicle key switch is in the ON position.

In accordance with one implementation, the vehicle power supply device is in electrical communication with the power input of the electrical switching device, and the wireless remote control receiver device controls electrical power to the accessory.

Other features and advantages of the invention will be set forth in, or apparent from, the detailed description of the exemplary embodiments of the invention found below.

DETAILED DESCRIPTION OF EXEMPLARY EMBODIMENTS OF THE INVENTION

The present invention is a system and method for wireless remote operation of an accessory associated with a vehicle, and, more particularly, for the wireless remote operation of a motor of the accessory.

Figure 1:
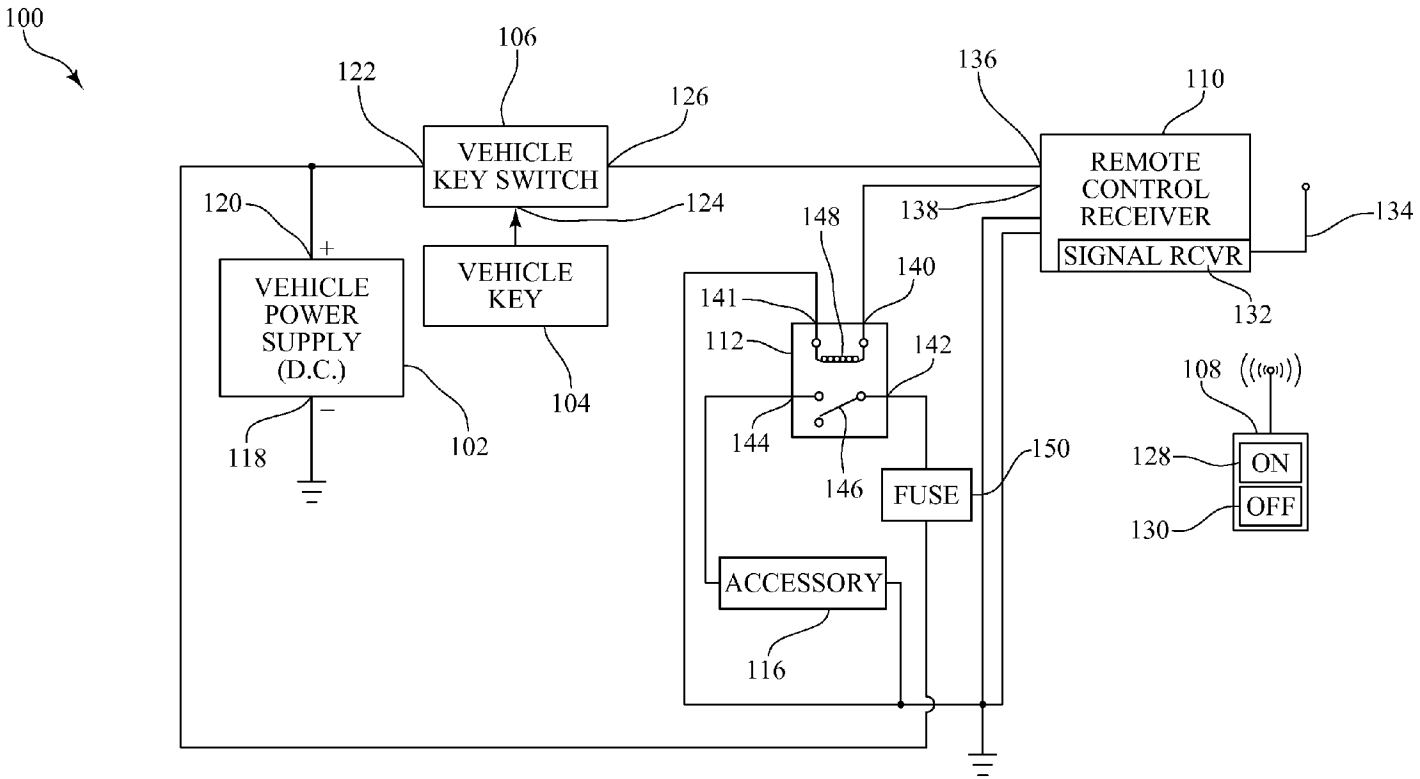
FIG. 1 is a schematic block diagram of an exemplary system for remote operation of an accessory associated with a vehicle, according to the invention.

FIG. 1 shows a first exemplary system 100 for wireless remote operation of an accessory associated with a vehicle, including a vehicle power supply device 102, a vehicle key 104, a vehicle key switch device 106, a wireless remote control transmitter device 108, and a wireless remote control receiver device 110. The first exemplary system 100 also includes an electrical switching device 112, and the accessory 116.

The vehicle power supply device 102, such as a 12 volt D.C. battery and alternator system of a truck, tractor, or mower supplies power to the vehicle. As shown, the vehicle power supply device 102 has a ground connection 118 and a D.C. voltage output 120.

The vehicle key 104 is encoded with a vehicle operation code for operating the vehicle. The vehicle key 104 may be a traditional key with notches or grooves cut into a blade to serve as the vehicle operation code, or an electronic key fob that wirelessly transmits, including but not limited to using an RF or infrared signal, a digital vehicle operation code, such as a key card system or other vehicle-specific switching devices.

The vehicle key switch device 106, such as an ignition switch, has a vehicle power supply input 122 in electrical communication with the D.C. voltage output 120 of the vehicle power supply device 102, a vehicle key receiver 124 for receiving the vehicle operation code from the vehicle key 104, and a vehicle key switch output 126. The vehicle key switch device 106 connects the vehicle power supply input 122 to the vehicle key switch output 126 in response to receiving the vehicle operation code from the vehicle key 104 and moving the vehicle key switch device 106 between an OFF position and an ON position.

The vehicle key switch device 106 may also have a START position in which a starter of the vehicle engages to start an engine of the vehicle. The START position is typically spring loaded so that the vehicle key switch device 106 will return to the ON position when the vehicle key switch device is released. The vehicle key switch device 106 will remain in the ON position while the engine of the vehicle is running.

The vehicle key switch device 106 disconnects the vehicle key switch output 126 from the vehicle power supply input 122 in response to moving the vehicle key switch device 106 between the ON position and the OFF position, thereby causing the engine of the vehicle to stop running. The vehicle key 104 (and, therefore, the vehicle operation code) can be removed from the vehicle key switch device 106 when the vehicle key switch device 106 is in the OFF position to prevent unauthorized operation of the vehicle and, as discussed below, operation of the accessory 116. In the situation where the vehicle key 104 is a traditional key with notches or grooves cut into a blade, removal of the vehicle key 104 may include physical removal of the traditional key from the vehicle key switch device 106. In the situation where the vehicle key 104 is an electronic key fob, removal of the vehicle key 104 may include removal of the electronic key from the proximity of the vehicle key switch device 106.

The wireless remote control transmitter device 108 includes a plurality of buttons for transmitting a respective plurality of signals (i.e., control signals) for control of the accessory 116. For instance, as shown, the wireless remote transmitter device 108 may be a two channel device including an ON button 128 for transmitting, such as by using an RF or infrared signal, an ON signal, and an OFF button 130 for transmitting an OFF signal. Alternately, the wireless remote control transmitter device 108 may include a RAISE button for transmitting a RAISE signal, and a LOWER button for transmitting a LOWER signal, or buttons for controlling the angle of a blade, the dumping of a dump cart, or the direction of turning of a motor.

The wireless remote control receiver device 110 has a signal receiver 132, preferably connected to an antenna 134, for receiving the signals from the wireless remote control transmitter device 108. The wireless remote control receiver device 110 also has an input 136 in electrical communication with the vehicle key switch output 126, and an output 138. Typically the wireless remote control receiver device 110 is a Direct Current (D.C.) device, but other power technologies are within the spirit and scope of the claimed invention. The input 136 provides operating power to the wireless remote control receiver device 110. Additionally, the wireless remote control receiver device 110 connects the input 136 to the output 138 in response to receiving the ON signal, and maintains the connection until the OFF signal is received. The wireless remote control receiver device 110 disconnects the input 136 from the output 138 in response to receiving the OFF signal, and maintains the disconnection until the ON signal is again received. Additionally, when the vehicle key switch device 106 is in the OFF position, power is disconnected from the input 136 of the wireless remote control receiver device 110, and, accordingly, there can be no signal at the output 138 regardless of any signals transmitted from the remote control transmitter device 108, as the wireless remote control receiver device 110 will not be operational.

Advantageously, the wireless remote control transmitter device 108 and the wireless remote control receiver device use radio frequency signals for communication of the signals, although one of skill in the art will recognize that other signal types, such as infrared (IR), could also be equivalently utilized. Unique addressing of the signals allows the wireless remote control transmitter device 108 and the wireless remote control receiver device 110 to be used in the vicinity of other transmitter and receiver devices without unwanted interference between the devices. A non-limiting example of a commercially available wireless remote control transmitter and receiver device system is the model RM01 12V 6A Relay w/Remote Control, sold by Logisys Computer Inc. of Pomona, Calif.

The electrical switching device 112 has a control input 140, a power input 142, a power output 144, and a switching mechanism 146 operably connected between the power input 142 and the power output 144. The control input 140 is in electrical communication with the D.C. output 138 of the wireless remote control receiver device 110. The switching mechanism 146, such as an armature movable between contacts, connects the power output 144 to the power input 142 when the D.C. voltage is present at the control input 140, and, likewise, disconnects the power output 144 from the power input 142 when the D.C. voltage is not present at the control input 140, such that the wireless remote control receiver device 110 can be used to control loads greater than its operating capacity. Thus, the wireless remote control receiver device 110 operates the electrical switching device 112.

As shown in FIG. 1, the electrical switching device 112 may be a mechanical relay having a ground connection 141, such that application of the D.C. voltage at the control input 140 causes current to flow through a coil 148 and actuate a mechanical switch that acts as the switching mechanism 146. Of course, one of skill in the art will recognize that other types of electrical switching devices are functionally equivalent to the mechanical relay, and within the spirit and the scope of the invention as described and claimed herein.

The accessory 116 is operably connected to the power output 144 of the electrical switching device 112, such that the accessory 116 starts operating in response to activation of the ON button 128 of the wireless remote control transmitter device 108 and stops operating in response to activation of the OFF button 130 of the wireless remote control transmitter device 108. For example, if the accessory 116 is a broadcast spreader, a motor that turns a spreading mechanism may be directly connected to the power output 144 of the electrical switching device 112.

While the accessory of the first exemplary embodiment 100 is a simple on/off accessory, one of skill in the art will recognize operation of accessories having RAISE/LOWER functions, blade angle functions, dumping functions, and "direction of turning" functions are within the spirit and scope of the invention as claimed herein, by utilizing wireless remote control transmitter 108 and a wireless remote control receiver 110 utilizing appropriate control signals.

In the first exemplary system 100, power to the accessory 116 is also provided by the vehicle power supply 102, and in the first exemplary system 100, the accessory 116 is protected by a fuse 150. Of course, one of skill in the art will recognize that the accessory 116 may alternatively have its own power supply (not shown) while still realizing the advantages and benefits of the invention as claimed hereafter.

Advantageously, the vehicle key switch device 106 must receive the vehicle operation code from the vehicle key 104 (such as by physical insertion and activation of the vehicle key switch device 106 by a traditional key) and be switched to the ON position before the accessory 116 can be activated, preventing operation of the accessory when the vehicle key 104 has been removed from the vehicle key receiver 124 or moved to the OFF position wherein the vehicle is not running, preventing the motor of the accessory 116 from accidentally draining a battery of the vehicle power supply 102 when the vehicle is not running.

Figure 2:
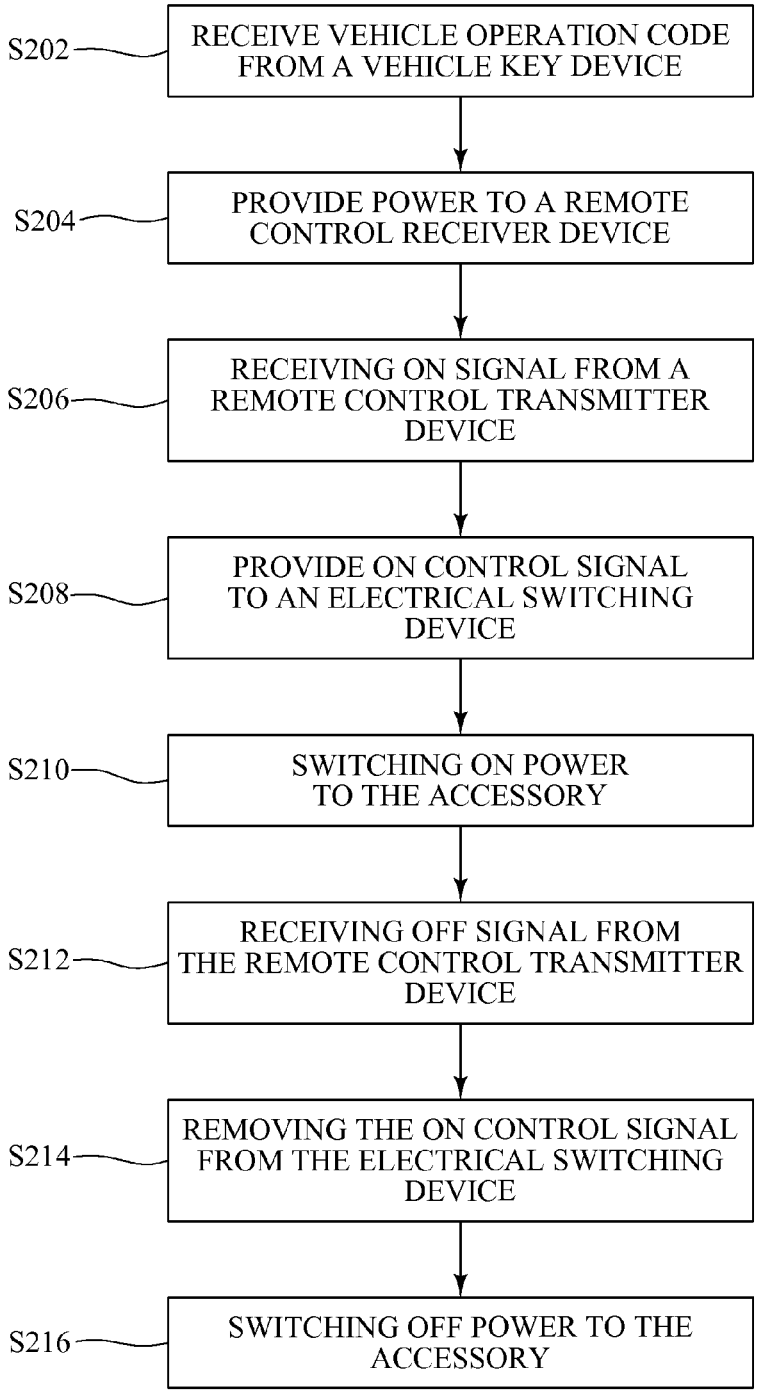
FIG. 2 is a flow chart of an exemplary method for remote operation of an accessory associated with a vehicle, according to the invention.

FIG. 2 is a flow chart of an exemplary method 200 for wireless remote operation of a motor associated with a vehicle, including the steps of: S202 receiving, by the vehicle key switch device, a vehicle operation code from a vehicle key and being placed in the ON position; S204 providing, by the vehicle key switch device, power to a wireless remote control receiver device; S206 receiving, by the wireless remote control receiver device, an ON signal from a wireless remote control transmitter device; S208 providing, by the wireless remote control receiver device, an ON control signal to an electrical switching device; S210 switching on, by the electrical switching device, power to the accessory; S212 receiving, by the wireless remote control receiver device, an OFF signal from a wireless remote control transmitter device; S214 removing, by the wireless remote control receiver device, the ON control signal from the electrical switching device; and S216 switching off, by the electrical switching device, power to the accessory. Thus, the accessory is started in response to receiving the ON signal from the wireless remote control transmitter device, and the accessory is stopped in response to receiving the OFF signal from the wireless remote control transmitter device. Additionally, in this exemplary method, operation of the accessory is prevented unless the vehicle operation code is received from the vehicle key and the vehicle key switch device is in the ON position.

In the first exemplary system 100 of FIG. 1, described above, the ON control signal is the D.C. voltage that is passed through the vehicle key switch device 106 upon receiving the vehicle operation code from the vehicle key 104 and movement of the vehicle key switch device 106 to the ON position, and is further passed through the wireless remote control receiver device 110 in response to receiving the ON signal from the wireless remote control transmitter device 108. The wireless remote control receiver device 110 removes the ON control signal from the electrical switching device 112 by disconnecting the input 136 from the output 138 in response to receiving the OFF signal from the wireless remote control transmitter device 108.

It is further noted that in the first exemplary system 100 and the exemplary method 200, a two-channel (ON signal/OFF signal) system and method is described, but that other systems utilizing three or more channels, therefore allowing for control of more than one motor or wireless remote devices, including variable speed motors and multiple setting motors, are within the spirit and scope of the invention as described and claimed herein.

Figure 3:
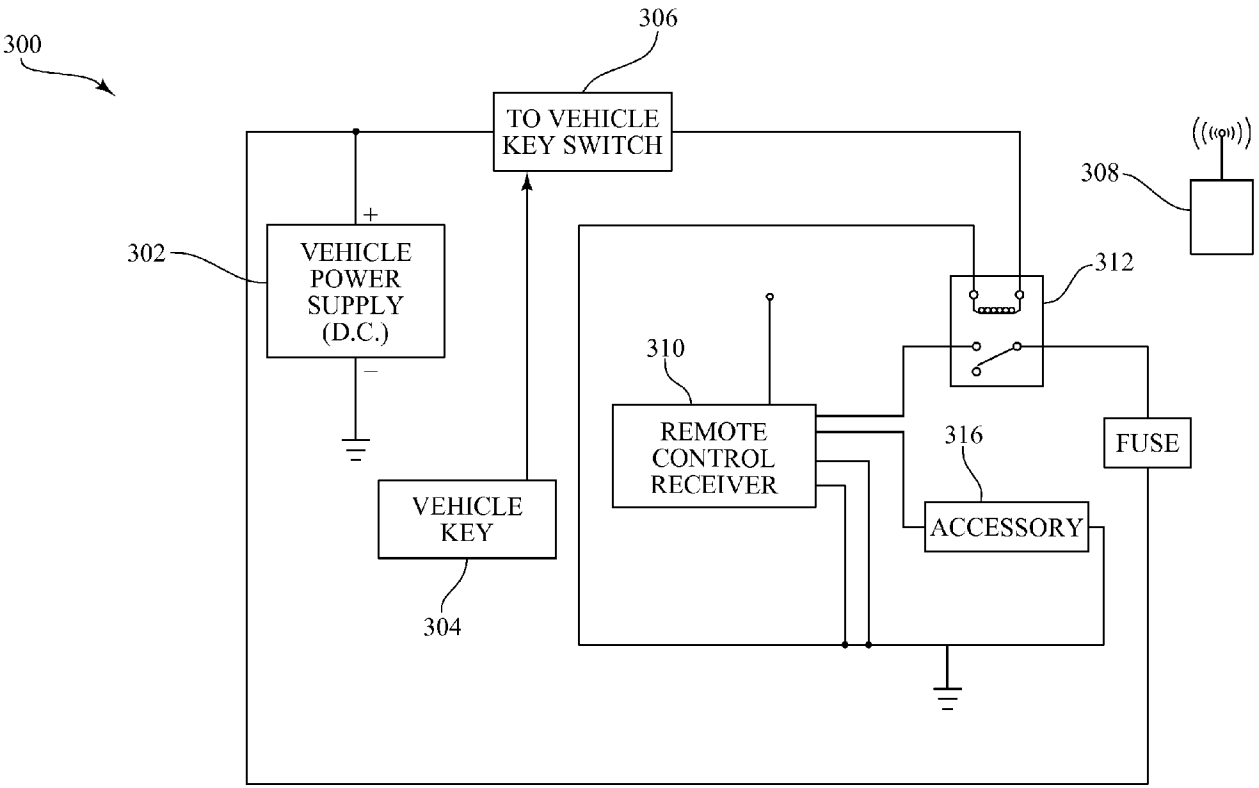
FIG. 3 a schematic block diagram of another exemplary system for remote operation of an accessory associated with a vehicle.

FIG. 3 shows a second exemplary system 300 for wireless remote operation of an accessory associated with a vehicle, including a vehicle power supply device 302, a vehicle key 304, a vehicle key switch device 306, a wireless remote control transmitter device 308, a wireless remote control receiver device 310, an electrical switching device 312, and an accessory 316. In the second exemplary system 300, the electrical switching device 312 is operably connected to the vehicle key switch device 306, such that power is supplied to the remote control receiver device 310 in response to activation of the vehicle key switch device 306 by the vehicle key 304. Then, the accessory 316 is operably connected to the remote control receiver device 310, such that the accessory 316 operates in response to signals received by the remote control receiver device 310 from the remote control transmitter device 308, as described above.

As mentioned above, exemplary accessories for the vehicle include a broadcast spreader or other lawn care equipment mounted or otherwise connected to or towed by the vehicle. However, the present invention is not limited to the wireless remote operation of such equipment, and other possible applications include turning on or off a motor for an electric sprayer, raising, lowering or adjusting spray booms, raising, lowering or activating a aerator, raising or lowering a blade, changing the angle of a blade, raising or lowering a dethatcher, raising, lowering or activating a tiller, trail mower, mower deck, or brush cutter, and dumping or raising a dump cart bed. With respect to raising, lowering, changing the angle, or dumping, it is noted that the wireless remote control transmitter device 108 and the wireless remote control receiver device 110 (FIG. 1), using multiple communication channels as described above, control the turning, leveling or tilting of an accessory in either a clockwise or a counterclockwise direction, as with, for example, a linear actuator), or control of more than one motor.

Figure 4:
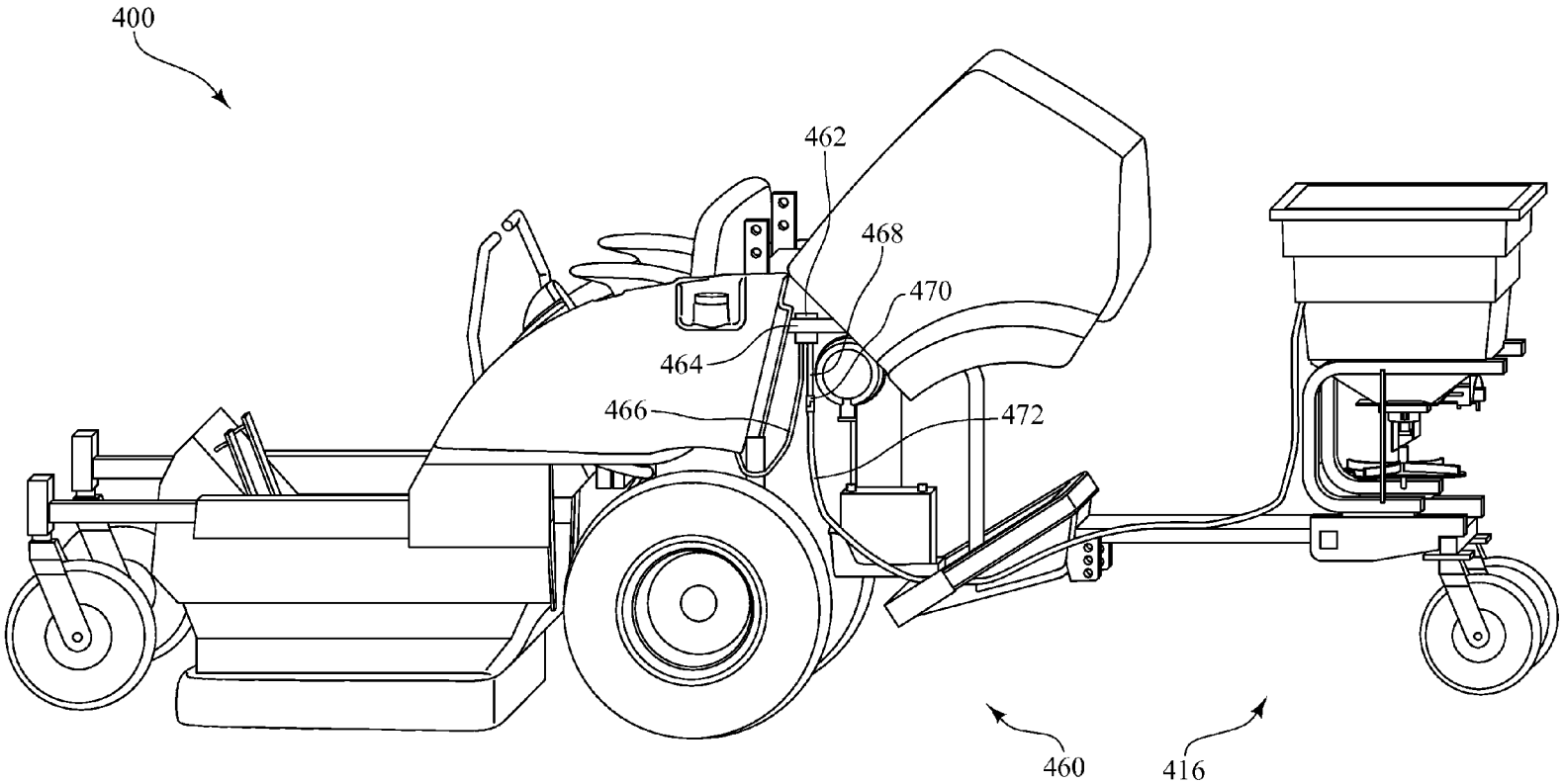
FIG. 4. is a schematic diagram of an exemplary mower vehicle and broadcast spreader accessory utilizing an exemplary system and method for remote operation of an accessory associated with a vehicle.

FIG. 4 is a schematic diagram of an exemplary mower vehicle 460 and broadcast spreader accessory 416 utilizing an exemplary system and method for remote operation of an accessory associated with a vehicle, as discussed above. For example, the broadcast spreader could be that described in co-pending and commonly owned U.S. patent application Ser. No. 12/701,378, which is incorporated herein by reference.

In use, a relay/receiver box 462 is secured to a bracket 464 of the mower vehicle 460. The relay/receiver box 462 contains a wireless remote control receiver device (e.g., FIG. 1, wireless remote control receiver device 110) and an electrical switching device (e.g., FIG. 1, electrical switching device 112). The relay/receiver box 462 is then operably connected by key switch wiring 466 to a vehicle key switch device (not shown) (e.g., FIG. 1, vehicle key switch device 106) of the mower vehicle 460 and by accessory connector wiring 468 to an accessory connector 470. Accessory wiring 472 is then connected between the accessory connector 470 and the accessory 416 to provide power for operation of the broadcast spreader accessory 416.

The key switch wiring 466 provides power to the relay/receiver box 462 when the vehicle key switch device receives a vehicle operation code from a vehicle key (not shown) and is moved from an OFF position to an ON position. Correspondingly, when the vehicle key switch device is moved from the ON position to the OFF position, to stop operation of the mower vehicle 460, power to the relay/receiver box 462 is disconnected, such that the broadcast spreader accessory 416 is also rendered powerless.

The accessory wiring 472 of the broadcast spreader accessory 416 can easily be electrically disconnected from the mower vehicle 460 at the accessory connector 470, and the broadcast spreader accessory 416 can be physically disconnected from the mower vehicle 460 for storage during periods of non-use.

Advantageously, the system and method described hereinabove allow wireless remote operation of accessories associated with vehicles, such that the vehicle operator need not leave the vehicle operator's position to operate such accessories. Further, permanent mounting at the operator's position of electronic controls for such accessories is not needed, so that the accessories can easily be attached to the vehicle, operated, and detached from the vehicle, as needed. Further still, bundling and tying of wires to the electronic controls is not required, as the communication between the controls and the accessories is wireless. Even further still, the system and method prevents electrically powered accessories from inadvertently remaining energized when the vehicle is not running, since the electronic controls for such accessories are powered through the key switch of the vehicle. Even further still, the system and method described hereinabove allow consistent application of accessories to a vehicle, such that installers will be familiar with installing such electrically powered accessories the same way for any of such electrically powered accessories.

One of ordinary skill in the art will also recognize that additional embodiments and configurations are also possible without departing from the teachings of the present invention or the scope of the claims which follow. This detailed description, and particularly the specific details of the exemplary embodiment disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A system for wireless remote operation of an accessory associated with a vehicle, comprising:

a vehicle power supply device for supplying electrical power to the vehicle;

a vehicle key encoded with a vehicle operation code for operating the vehicle;

a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position;

an electrical switching device including a control input in electrical communication with the vehicle key switch output, a power input, a power output, and a switching mechanism for connecting the power output to the power input when a control signal is present at the control input;

a wireless remote control transmitter device for transmitting a plurality of signals; and a wireless remote control receiver device including a signal receiver for receiving the plurality of signals from the wireless remote control transmitter device, an input in electrical communication with the power output of the electrical switching device, and an output in electrical communication with the accessory such that the wireless remote control receiver device controls the accessory based on the plurality of signals received from the wireless remote control transmitter device when the vehicle key switch is in the ON position.

2. The system of claim 1, wherein the wireless remote control transmitter device has an ON button for transmitting an ON signal, and an OFF button for transmitting an OFF signal, wherein a motor of the accessory is started by the wireless remote control receiver device in response to activation of the ON button of the wireless remote control transmitter device and stopped by the wireless remote control receiver device in response to activation of the OFF button of the wireless remote control transmitter device.

3. The system of claim 2, wherein the accessory is a broadcast spreader.

4. The system of claim 2, wherein the accessory is a sprayer, and wherein the motor drives a pump of the sprayer.

5. The system of claim 1, wherein the wireless remote control transmitter device has a RAISE button for transmitting a RAISE signal, and a LOWER button for transmitting a LOWER signal, wherein the wireless remote control receiver device causes the accessory to be raised in response to activation of the RAISE button of the wireless remote control transmitter device and lowered in response to activation of the LOWER button of the wireless remote control transmitter device.

6. The system of claim 5, wherein the accessory is an aerator, a blade, a mower deck, a tiller, a scoop, a dump bucket, a pallet mover or a dethatcher.

7. The system of claim 1, wherein the vehicle power supply device is in electrical communication with the power input of the electrical switching device, and the wireless remote control receiver device controls electrical power to the accessory.

8. The system of claim 1, wherein the accessory is a blade, and wherein the wireless remote control receiver device controls an angle of the blade.

9. The system of claim 1, wherein the accessory is a dump cart, and wherein the wireless remote control receiver device controls dumping of the dump cart.

10. The system of claim 1, wherein the wireless remote control receiver device controls a direction of turning of a motor of the accessory in response to receiving a corresponding signal from the wireless remote control transmitter device.

11. A system for wireless remote operation of an accessory associated with a vehicle, comprising:

a vehicle power supply device for supplying electrical power to the vehicle;

a vehicle key encoded with a vehicle operation code for operating the vehicle;

a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position;

a wireless remote control transmitter device for transmitting a plurality of signals; and a wireless remote control receiver device including a signal receiver for receiving the plurality of signals from the wireless remote control transmitter device, an input in electrical communication with the vehicle key switch output, and an output in electrical communication with the accessory such that the wireless remote control receiver device controls the accessory based on the plurality of signals received from the wireless remote control transmitter device when the vehicle key switch is in the ON position, wherein the wireless remote control receiver device controls a direction of turning of a motor of the accessory in response to receiving a corresponding signal from the wireless remote control transmitter device.

12. A method for wireless remote operation of an accessory associated with a vehicle, the vehicle comprising: a vehicle power supply device for supplying electrical power to the vehicle; a vehicle key encoded with a vehicle operation code for operating the vehicle; and a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position; the method comprising:

providing an electrical switching device including a control input in electrical communication with the vehicle key switch output, a power input, a power output, and a switching mechanism for connecting the power output to the power input when a control signal is present at the control input;

providing a wireless remote control transmitter device for transmitting a plurality of signals;

providing a wireless remote control receiver device including a signal receiver for receiving the plurality of signals from the wireless remote control transmitter device, an input in electrical communication with the power output of the electrical switching device, and an output in electrical communication with the accessory;

providing, by the vehicle key switch device, power to the wireless remote control receiver device in response to receiving the vehicle operation code from the vehicle key and movement of the vehicle key switch device from the OFF position to the ON position; and controlling, by the wireless remote control receiver device, the accessory based on the plurality of signals received from the wireless remote control transmitter device.

13. The method of claim 12, further comprising disconnecting, by the vehicle key switch device, power to the wireless remote control receiver device in response to movement of the vehicle key switch device from the ON position to the OFF position.

14. The method of claim 12, wherein the vehicle power supply device supplies electrical power to the accessory, and the wireless remote control receiver device controls the electrical power to the accessory.

15. The method of claim 12, wherein the wireless remote control transmitter device has an ON button for transmitting an ON signal, and an OFF button for transmitting an OFF signal, further comprising starting, by the wireless remote control receiver device, a motor of the accessory in response to activation of the ON button of the wireless remote control transmitter device, and stopping, by the wireless remote control receiver device, the motor of the accessory in response to activation of the OFF button of the wireless remote control transmitter device.

16. The method of claim 12, wherein the wireless remote control transmitter device has a RAISE button for transmitting a RAISE signal, and a LOWER button for transmitting a LOWER signal, further comprising raising, by the wireless remote control receiver device, the accessory in response to activation of the RAISE button of the wireless remote control transmitter device, and lowering, by the wireless remote control receiver device, the accessory in response to activation of the LOWER button of the wireless remote control transmitter device.

17. A method for wireless remote operation of an accessory associated with a vehicle, the vehicle comprising: a vehicle power supply device for supplying electrical power to the vehicle; a vehicle key encoded with a vehicle operation code for operating the vehicle; and a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position; the method comprising:

providing a wireless remote control transmitter device for transmitting a plurality of signals and a wireless remote control receiver device including a signal receiver for receiving the plurality of signals from the wireless remote control transmitter device, an input in electrical communication with the vehicle key switch output, and an output in electrical communication with the accessory;

providing, by the vehicle key switch device, power to the wireless remote control receiver device in response to receiving the vehicle operation code from the vehicle key and movement of the vehicle key switch device from the OFF position to the ON position; and controlling, by the wireless remote control receiver device, the accessory based on the plurality of signals received from the wireless remote control transmitter device;

wherein the wireless remote control transmitter device has a first rotational direction button for transmitting a first rotational direction signal, and a second rotational direction signal button for transmitting a second rotational direction signal, further comprising causing, by the wireless remote control receiver device, the accessory to have a first rotational direction in response to activation of the first rotational direction button of the wireless remote control transmitter device, and causing, by the wireless remote control receiver device, the accessory to have a second rotational direction in response to activation of the second rotational direction button of the wireless remote control transmitter device.

18. A system for wireless remote operation of an accessory associated with a vehicle, comprising:

a vehicle power supply device for supplying electrical power to the vehicle;

a vehicle key encoded with a vehicle operation code for operating the vehicle;

a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position;

a wireless remote control transmitter device for transmitting a plurality of signals; and a wireless remote control receiver device including a signal receiver for receiving the plurality of signals from the wireless remote control transmitter device, an input in electrical communication with the vehicle key switch output, and an output in electrical communication with the accessory such that the wireless remote control receiver device controls the accessory based on the plurality of signals received from the wireless remote control transmitter device when the vehicle key switch is in the ON position, wherein the accessory is a blade, and wherein the wireless remote control receiver device controls an angle of the blade.

19. A system for wireless remote operation of an accessory associated with a vehicle, comprising:

a vehicle power supply device for supplying electrical power to the vehicle;

a vehicle key encoded with a vehicle operation code for operating the vehicle;

a vehicle key switch device including a vehicle power supply input in electrical communication with the vehicle power supply device, a vehicle key receiver for receiving the vehicle operation code from the vehicle key, and a vehicle key switch output, the vehicle key switch device switching connection of the vehicle key switch output to the vehicle power supply input in response to receiving the vehicle operation code from the vehicle key and moving the vehicle key switch device between an OFF position and an ON position;

a wireless remote control transmitter device for transmitting a plurality of signals; and a wireless remote control receiver device including a signal receiver for receiving the plurality of signals from the wireless remote control transmitter device, an input in electrical communication with the vehicle key switch output, and an output in electrical communication with the accessory such that the wireless remote control receiver device controls the accessory based on the plurality of signals received from the wireless remote control transmitter device when the vehicle key switch is in the ON position, wherein the accessory is a dump cart, and wherein the wireless remote control receiver device controls dumping of the dump cart.

* * * * *